US005265631A

United States Patent [19]

Goettl

[11] Patent Number: 5,265,631

[45] Date of Patent: Nov. 30, 1993

[54] SWIMMING POOL DEBRIS COLLECTION TRAP

[75] Inventor: John M. Goettl, Phoenix, Ariz.

[73] Assignee: Paramount Leisure Industries, Inc., Scottsdale, Ariz.

[21] Appl. No.: 820,745

[22] Filed: Jan. 13, 1992

Related U.S. Application Data

[63] Continuation-in-part of Ser. No. 428,862, Oct. 30, 1989, Pat. No. 5,135,579.

[51] Int. Cl.[5] ..... B08B 3/04

[52] U.S. Cl. ..... 134/111; 134/169 R; 134/166 R; 210/453

[58] Field of Search ..... 210/776, 450, 453, 169; 134/111, 167 R, 169 R, 166 R

[56] References Cited

U.S. PATENT DOCUMENTS

| | | | |
|---|---|---|---|
| B1 4,501,659 | 9/1986 | Henk . | |
| 2,914,180 | 11/1959 | Konopka et al. | 210/169 X |
| 3,045,829 | 7/1962 | Rule et al. . | |
| 3,245,420 | 4/1966 | Cherney | 134/111 X |
| 3,443,264 | 5/1969 | Miller | 134/167 R |
| 3,486,623 | 12/1969 | Bosico . | |
| 3,506,489 | 4/1970 | Baker . | |
| 3,567,020 | 3/1971 | Whitaker | 210/169 X |
| 3,615,013 | 10/1971 | Reece . | |
| 3,909,415 | 9/1975 | Young | 210/169 X |
| 4,193,870 | 3/1980 | Goodin . | |
| 4,330,412 | 5/1982 | Frederick . | |
| 4,419,233 | 12/1983 | Baker . | |
| 4,776,953 | 10/1988 | Frentzel | 134/167 R X |
| 4,818,398 | 4/1989 | Lott et al. | 210/450 X |
| 4,832,838 | 5/1989 | Stone . | |
| 5,074,381 | 12/1991 | Minord et al. | 210/453 X |
| 5,114,572 | 5/1992 | Hunter | 210/450 X |

FOREIGN PATENT DOCUMENTS 825470 12/1959 United Kingdom ..... 210/169

OTHER PUBLICATIONS

Arneson Publication May 1987.

*Primary Examiner*—Frankie L. Stinson
*Attorney, Agent, or Firm*—J. F. McLellan

[57] ABSTRACT

A swimming pool debris collection trap for separating debris from water passing through a pool water recirculating system.

The collection trap is located at poolside below pool deck level and comprises a tank having upper and lower seats dividing the tank into upper, lower and intermediate chambers.

The intermediate chamber between the seats is connected to the pool by a trap suction line. Water from the suction line flows into the open upper end of a foraminous container resting upon the lower seat and extending into the lower chamber. The container traps debris but allows water to flow into the lower chamber for return to the pool through a trap discharge line.

The container is removable through a cap opening provided in the intermediate chamber and normally closed by a sealing cap.

A balance passage connects the pool to the upper chamber for filling it with water to a level above the upper seat. The presence of this water stops any air from entering the intermediate chamber and preventing development of pump suction in the lower chamber.

The collection trap is of relatively high capacity to receive large quantities of leaves and other debris in water pumped from the pool by various means. It acts also as a skimmer basket and a pump basket.

One embodiment of the sealing cap automatically prevents development of an excessive vacuum in the recirculation system, and another embodiment can regulate water flow into the intermediate chamber.

11 Claims, 6 Drawing Sheets

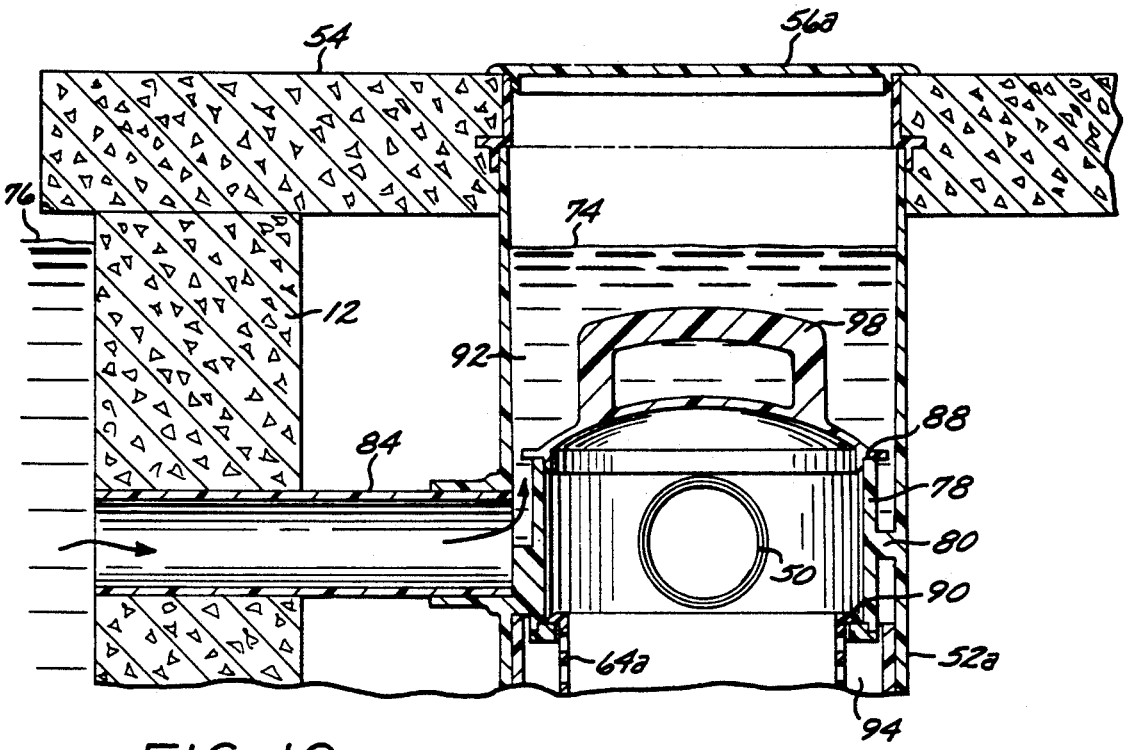
FIG. 10
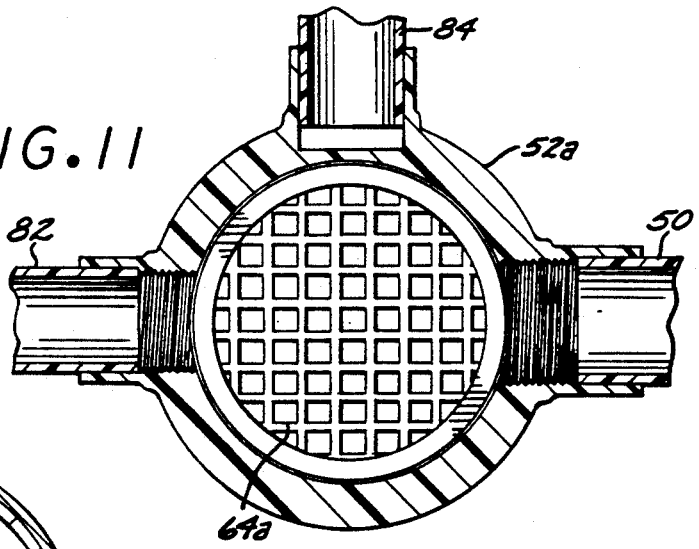
FIG. 11
FIG. 12
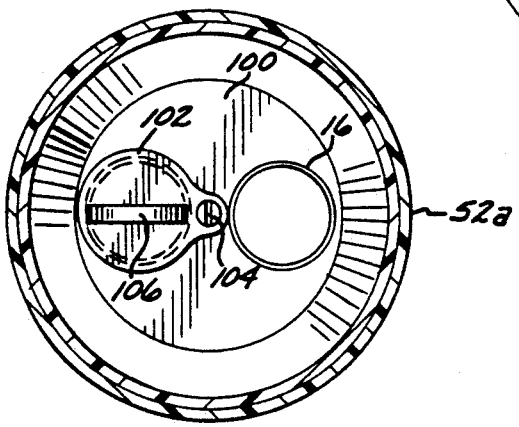

SWIMMING POOL DEBRIS COLLECTION TRAP

CROSS REFERENCE TO RELATED APPLICATION

This application is a continuation-in-part of my copending patent application Ser. No. 07/428,862, filed Oct. 30, 1989, now U.S. Pat. No. 5,135,579, and entitled, "METHOD AND APPARATUS FOR REMOVING SEDIMENT FROM A POOL", and the benefit of that filing date is claimed for subject matter common this application.

BACKGROUND OF THE INVENTION

1. Field of the Invention

The present invention relates to a swimming pool debris collection trap for separating debris from pool water.

2. Description of the Prior Art

It is relatively easy to separate and collect light debris suspended in or floating upon the surface of pool water. Typically, the suspended debris is separated upon passage of the water through a pool filter, while the floating debris collects in a skimmer basket into which it is carried by wind and water currents. Such a skimmer basket is relatively easily removable for emptying.

However, often the skimmer basket is of low capacity or is ineffective to catch all of the debris, and a strainer or pump basket is provided to protect the pump from debris not trapped by the skimmer basket. Removal of the pump basket for emptying is not easily done. Because the pump basket housing is exposed to atmospheric pressure, a cover must be provided to prevent air entry into the pump system. The fact that the cover must be tightly closed or dogged down each time it is removed complicates the task of emptying the pump basket, and the small capacity of such a pump basket requires that it be cleaned out relatively frequently.

Heavier, non-floating debris such as sand, seed pods and water soaked leaves is not as easily separated. Various kinds of collection traps have been designed to collect this kind of debris, including leaf baskets located over the main drain, leaf bags associated with pool suction cleaners, and leaf bags or collection containers carried by pool cleaners driven by water pressure over the pool surfaces. These traps are in addition to the pump and skimmer baskets employed to collect light debris.

A system is disclosed in my copending application Ser. No. 07/428,362, filed Oct. 30, 1989 for "METHOD AND APPARATUS FOR REMOVING SEDIMENT FROM A POOL" which eliminates any need for a plurality of baskets and traps, and particularly any need for a separate pump basket. Instead, one relatively large capacity, easily serviceable collection trap is provided for the collection of both light and heavy debris. It is also characterized by submergence of the debris collection container cap so that sealing clamps and the like are not necessary to prevent air entry into the pump system.

The system utilizes a combination of specially located rotatable and non-rotatable nozzles acting in concert to move the heavy debris through a relatively large main drain and into a leaf receiving means for retaining the leaves and passing the accompanying water.

SUMMARY OF THE INVENTION

According to the present invention, an improved swimming pool debris collection trap is provided which is adapted not only for use with the apparatus of my above-identified copending patent application, but also for use with various other systems designed to pump or otherwise urge pool water and accompanying debris from a swimming pool for separation of the debris from the water.

The present collection trap is preferably recessed below the pool deck so that it can be relatively large without being obtrusive. It comprises a tank having upper and lower seats dividing the tank into upper, lower and intermediate chambers. The intermediate chamber between the seats is connected to a trap suction line to accept pool water and debris from any one or more sources, including the main drain, the usual skimmer weir, pool suction cleaners, either manually or jet driven over the pool surfaces, and heavy debris and leaf collection systems such as that described in my above-mentioned patent application.

The trap includes a single, relatively large capacity foraminous collection container having an open upper end into which flow the contents of the intermediate chamber. The container rests upon the lower seat and extends into the lower chamber. Debris is trapped in the container, but water is allowed to flow into the lower chamber for discharge to the pool through a trap discharge line. The container can be reached from above for removal through a cap opening in the intermediate chamber. A sealing cap normally rests upon the cap opening.

The upper chamber is maintained in a flooded condition by reason of water flow from the pool through a balance passage. Thus, despite the absence of positive seals, air cannot enter the intermediate chamber past the sealing cap.

The collection trap is adapted to include valve means for controlling the flow of water out of the lower chamber to an auxiliary pump for actuating pool nozzles or the like.

In one embodiment the trap accepts water through a primary trap suction line connected, for example, to the main drain, and it also accepts water through a secondary trap suction line connected to the skimmer. The sealing cap mounts spring biased valve means which normally close the secondary trap suction line. However, the valve means is movable to an open position upon development of a high differential pressure across the valve means. This admits water from the primary trap suction line and thereby automatically prevents development of an excessive vacuum in the pump water recirculation system.

In another embodiment the sealing cap includes a plurality of ports, and the cap is rotatable upon its seat to selectively bring such ports into partial or complete alignment with primary and secondary trap suction lines to control or regulate the flow of water into the intermediate chamber from the suction lines.

Other objects and features of the invention will become apparent from consideration of the following description taken in conjunction with the accompanying drawings.

BRIEF DESCRIPTION OF THE DRAWINGS

FIG. 10 is a view taken along the line 10—10 of FIG. 9;

FIG. 11 is a view taken along the line 11—11 of FIG. 9;

FIG. 12 is a view taken along the line 12—12 of FIG. 9;

DESCRIPTION OF THE PREFERRED EMBODIMENTS

Figure 1:
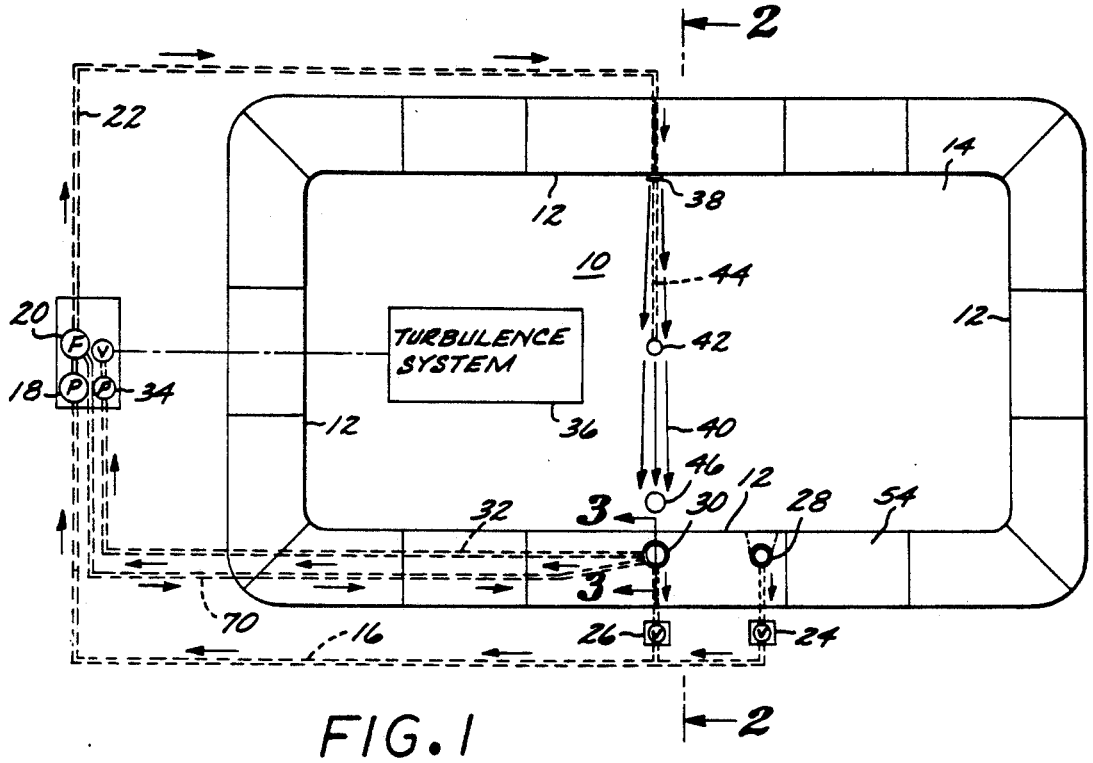
FIG. 1 is a schematic plan view of a swimming pool equipped with apparatus for removing leaves from the pool.

Referring now to the drawings and particularly to FIGS. 1-6, a system is illustrated in FIGS. 1, 2 and 6-8 which incorporates one form of leaf receiving means or debris collection trap 30 according to the present invention. As will be seen, the collection trap 30 is adapted to operate in association with various forms of pool cleaning system, but the system shown is illustrated because it works particularly well with the collection trap 30.

In this regard, the debris collection traps illustrated in FIGS. 9-14 also work well with the pool cleaning system of FIGS. 1, 2 and 6-8. However, they are also adapted to operate with many other types of pool cleaning systems, inasmuch as they are not dependent upon the particular manner in which debris is collected and routed to the present debris collection traps.

The pool cleaning system of FIGS. 1-8 is illustrated in association with a generally rectangular water filled swimming pool 10 having sides 12 and a bottom 14. Although any of a variety of plumbing systems can satisfactorily be employed, the system illustrated is typical, including a main trap discharge line 16 which carries water to the inlet side of a main pump 18 whose discharge is connected to the inlet side of a filter 20 for discharge through an outlet conduit 22.

The line 16 is selectively coupled through valves 24 and 26, respectively, to a conventional pool skimmer 28 opening out of a side of the pool, and to a leaf receiving means or debris collection trap 30. The trap 30 is also coupled by an auxiliary trap discharge line 32 to the inlet side of a booster or auxiliary pump 34 whose discharge operates a local area turbulence system generally designated by the numeral 36.

Although turbulence in localized regions of the pool can be achieved by manual means, such as by brushes mounted to long handles, an automatic turbulence system 36 is preferred because it operates continuously and contemporaneously with the stationary jets of the present apparatus, as will be seen, and tends to keep leaves and other debris in motion in the localized region in which it is operating. The system 36 can be of that type which is movable through successive smaller or localized regions of the pool, employing flexible hoses from which streams or jets of water are discharged. The reaction from the jets moves the hoses in a sinuous fashion, directing the discharged water randomly over the adjacent pool surfaces and physically scrubbing the hoses against the pool surface. Rotary jets can also be used, as will be seen.

The turbulence system 36 is effective to place smaller contaminant particles in suspension for circulation to the filter, and suspend and move heavier debris such as leaves a short distance within the localized region in which the system 36 is operating.

A stationary jet means or nozzle 38 is mounted to a side of the pool approximately midway between its opposite ends. It is coupled to the outlet conduit 22 and oriented to direct its jet of water downwardly and along a fixed direction pathway 40 extending down the side and across the bottom of the pool, as indicated by the arrows seen in FIG. 2.

A second stationary nozzle 42 is mounted to the bottom of the pool in the pathway 40 and oriented to direct its jet of water across the bottom of the pool in a path coincident with the pathway 40 to augment and accelerate the flow of water in the pathway. Like the nozzle 38, the nozzle 42 is coupled to the pump outlet conduit 22, but by a branch conduit 44.

A leaf or debris collection inlet means 46 is preferably located in the pool bottom adjacent the side of the pool opposite the stationary jet 38. It is fixed in position in the pathway 40 to intercept and receive debris carried by the stream of water which defines the pathway.

Figure 2:
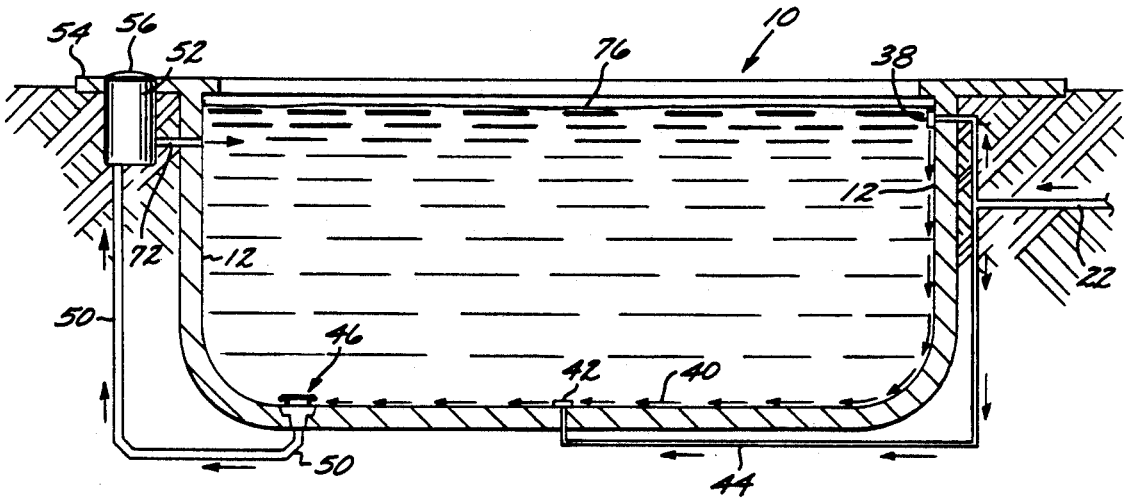
FIG. 2 is an enlarged view taken along the line 2—2 of FIG. 1.

The system of FIG. 2 is intended for use with a comparatively small pool, such as a 15 foot by 30 foot pool for example. The system of FIG. 7 is also designed for a smaller pool but it employs a particular local area turbulence system operative over larger local areas, as compared to a sweep hose system which must operate on successive smaller local areas.

Figure 7:
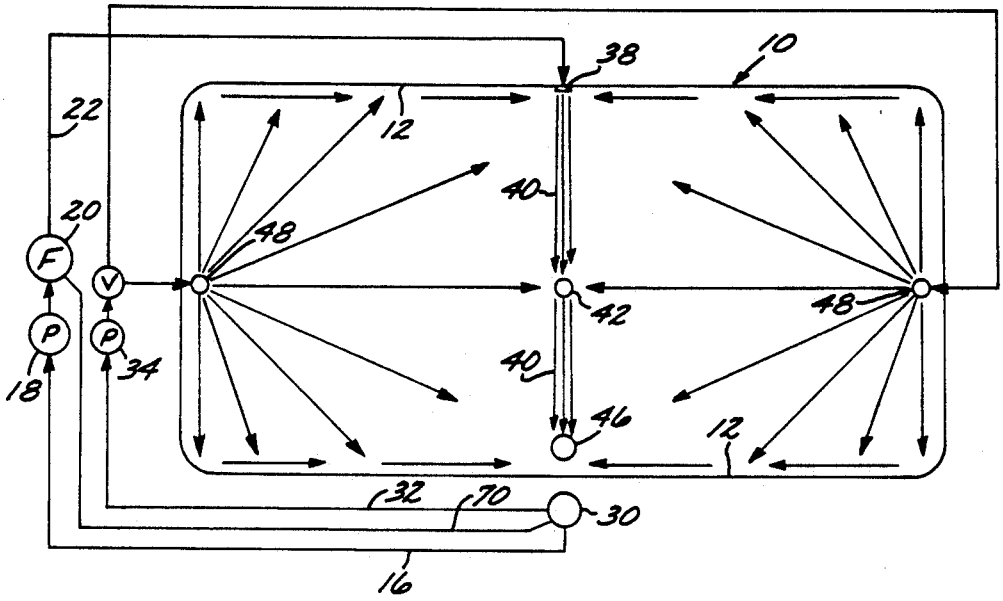
FIG. 7 is a schematic plan view of a swimming pool similar to that of FIG. 1, but employing rotary jets to induce turbulence in the local areas at opposite ends of the pool.

The system illustrated in FIG. 7 employs a pair of rotary nozzles 48 of any suitable type, such as the type disclosed in U.S. Pat. No. 3,506,489 (Baker) issued Apr. 14, 1970. The angular direction of the jet from each nozzle 48 is changed from one angular sector to another by a valve means which is associated with the nozzle and which is effective intermittently to shut off and turn on the flow of water to the nozzle and cause it to shift the jet stream position.

The Baker rotary nozzle is representative of rotary nozzles for directing a stream of water successively to successive sectors of the pool for relatively prolonged periods of time to extend the path of the discharged water, and thereby induce turbulence over a relatively widespread local region of the pool. Any of these nozzles can be used in the present apparatus.

In the example illustrated in FIG. 7, the pair of rotary nozzles 48 provides sufficient turbulence in the opposite halves of the pool to move debris about in random fashion along the water flow paths indicated by the arrows. The debris drifting into or encountering the more swiftly flowing streams or pathways 40 provided by the stationary jets 38 and 42 will be carried along those pathways. In this respect the operation of the system of FIG. 7 is like that of FIG. 2.

Figure 8:
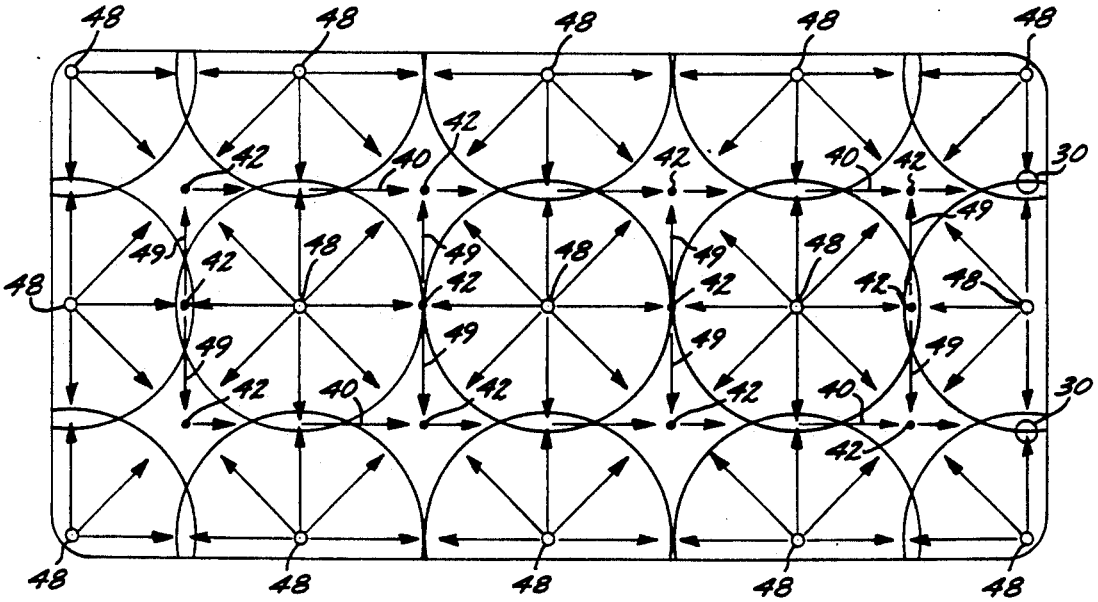
FIG. 8 is a schematic plan view of a larger pool employing a plurality of local area turbulence inducing means in combination with a plurality of stationary jets providing gathering streams or pathways extending through the local regions and terminating in a pair of debris collection traps.

FIG. 8 illustrates a local area turbulence system better suited for relatively large pools in the order of 40 feet by 80 feet. A plurality of rotary nozzles 48 are employed at regular spaced intervals throughout the pool. The nozzles 48 are arranged in parallel longitudinal and transverse rows as illustrated. The local regions in which turbulence is induced by each of the nozzles 48 is schematically indicated by the partial or full circles adjacent to the nozzles.

The system of FIG. 8 also includes a plurality of stationary nozzles 42 arranged in parallel longitudinal and transverse rows. The longitudinal rows establish longitudinally directed primary leaf or debris gathering pathways 40, as indicated by the longitudinally directed arrows, while the nozzles 42 located between the longitudinal rows direct streams of water in opposite, lateral directions to establish secondary pathways, as indicated by the arrows 49.

The action of the rotary nozzles 48 randomly outwardly moves debris located in their local regions for interception by either the pathways 40 or 49. Debris entrained in the secondary pathways 49 moves to the pathways 40, and is carried along the pathways 40 to the collection inlet means 46 of a pair of leaf or debris receiving means 30.

In both the embodiments of FIG. 2 and FIG. 8 the mixture of debris and water passing into the debris receiving means is carried by a primary trap suction line 50 to the base of a cylindrical collector tank 52 which forms part of the externally located debris collecting means of the receiving means 30. The tank is mounted within a suitable opening in the pool deck 54 and its open upper end is closed by a removable cover 56.

A mount 58 disposed within the tank 52 includes a downwardly oriented cylindrical flange 60 which slidably fits over the upper extremity of the cylindrical primary trap suction line 50. The mount 58 further includes an arcuate seat or recess which receives a pivotable valve means or closure 62.

Figure 4:
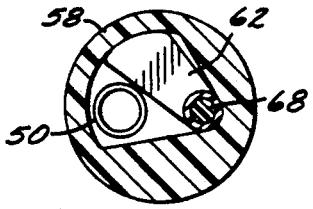
FIG. 4 is a view taken along the line 4-4 of FIG. 3, illustrating the handle valve means in an open position.
Figure 5:
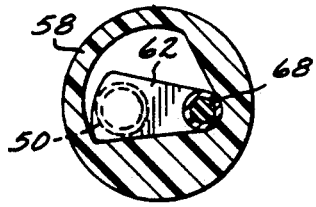
FIG. 5 is a view similar to FIG. 4, but illustrating the handle valve means in a closed position.
Figure 6:
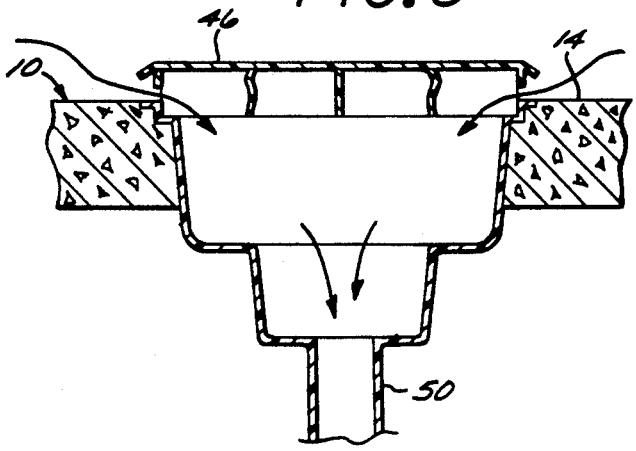
FIG. 6 is an enlarged view of the collection inlet leading to the debris collection trap.

As best seen in FIGS. 4 and 5, the closure 62 can be pivoted from the open position illustrated in FIG. 4 to the closed position illustrated in FIG. 5. In the open position water and debris are free to flow through the mount 58 into the interior of a foraminous strainer leaf collector, bag or container 64. The lower end of the container 64 fits over a groove in the periphery of the mount 58 and is removably held in place by an elastic cord or ring 66.

Figure 3:
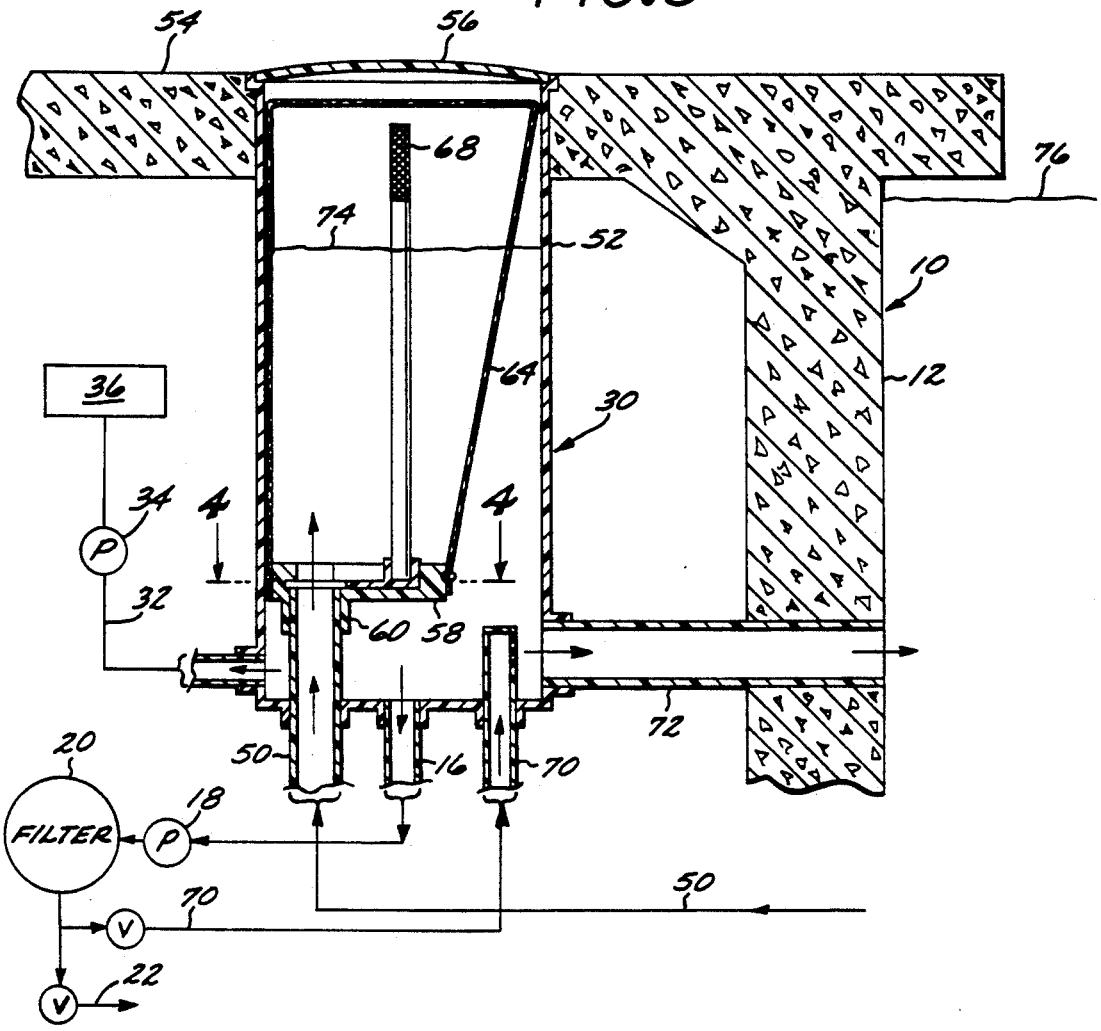
FIG. 3 is an enlarged view taken along the line 3—3 of FIG. 1, and illustrating one form of leaf receiving or debris collection trap.

The container 64 can be made of any suitable material, such as rigid screening or other apertured material, but the foraminous flexible container 64 is preferred. It is illustrated in FIG. 3 in the shape it would assume with water passing into it from the conduit 50. This water passes through the container and into the tank 52, and the remaining debris collected in the bag 64 is easily removed by taking off the cover 56 and slidably separating the mount 58 from the suction line 50. This is done by pulling upwardly on an elongated, vertically oriented handle 68 which is also used for pivoting the closure 62.

The base of the tank also includes a flanged opening for coupling the tank 52 to the main trap discharge line 16 on the inlet side of the main pump 18. The outlet said of the pump 18 is coupled to a tank inlet conduit 70 which discharges into the base of the tank 52.

The upper extremity of the conduit 70 includes one or more small apertures which serve as venturi nozzles to discharge water at increased velocity through the water in the base of the tank 52, and into a tank discharge conduit 72 which empties into the pool 10. The venturi effect enhances rapid flow of water from the tank 52 back into the pool. However, it should be understood that the presence of the venturi nozzles is not an essential part of the present system.

The suction side of both the pump 18, and that of the auxiliary pump 34, if one is used, are coupled to the tank 52 so that water passing to the pumps is already purged of debris. Consequently, the usual low capacity pump baskets located on the inlet side of the main pump, and on the inlet side of any auxiliary pump, need not be depended upon for debris collection. Such baskets could still be used, if desired, to provide an extra measure of protection against any possible damage to the pumps. Under these circumstances such baskets would require only infrequent cleaning.

Use of an auxiliary pump 34 coupled to the tank 52 is helpful to further increase the rate of flow of debris and water into the container 64 from the enlarged or oversize primary trap suction line 50.

The height of the tank 5 is made such that the normal operational drawdown or lowering of the water operating level 74 in the tank places the level 74 below the pool waterline 76, as seen in FIG. 3. This difference in water level improves discharge flow from the tank 52 through the tank discharge conduit 72. It also allows a backflow of water from the pool to the tank 52 to maintain pump suction should the connecting trap suction line 50 become blocked and fail to allow water to come into the tank from the collection inlet means 46.

In operation, and assuming that an auxiliary pump 34 is utilized to operate a turbulence system 36 like that of FIG. 7, the rotary nozzles 48 will develop turbulence in a pair of relatively widespread local regions at opposite ends of the pool. Debris will be moved randomly toward the fixed direction, relatively swiftly flowing stream or pathway 40 developed by the stationary nozzles 38 and 42 which crosses the local turbulent regions. The debris will be captured by the pathway 40 and discharged into the inlet means 46 of the debris collection trap means 30. From there it will be carried by the connecting conduit 50 into the interior of the container 64.

The debris is retained in the container, and water passes from the container into the tank 52 and then back to the pool through the tank discharge conduit 72. The venturi nozzles of the conduit 70 enhance the rate of this discharge. As previously indicated, the rate of discharge is further accelerated by connection of the auxiliary pump inlet to the tank 52.

With the foregoing arrangement, the pathway 40 is always directionally oriented to terminate at the inlet to the debris collection trap 30. Its continuous flow develops a momentum extending the pathway 40 the full length of the average size pool, and the pathway 40 is not appreciably diminished or deflected in direction by the local eddies developed by any turbulence system 36. Consequently, any debris located in or adjacent the pathways is captured and carried to the inlet means 46. Streams of water which are random or which sweep through a pool sector are not relied upon for debris removal, but serve only to develop local area turbulence to ready the debris for capture by the steady state flow of the pathway 40 or pathways, as the case may be.

Referring now to FIGS. 9–12, a second embodiment of the debris collection trap is illustrated which is generally related to the trap 30 of FIGS. 1–8. For convenience, identical parts are assigned the same numerals, parts which operate in a similar way are assigned the same numerals with the notation "a", and different parts are assigned different numerals.

Figure 9:
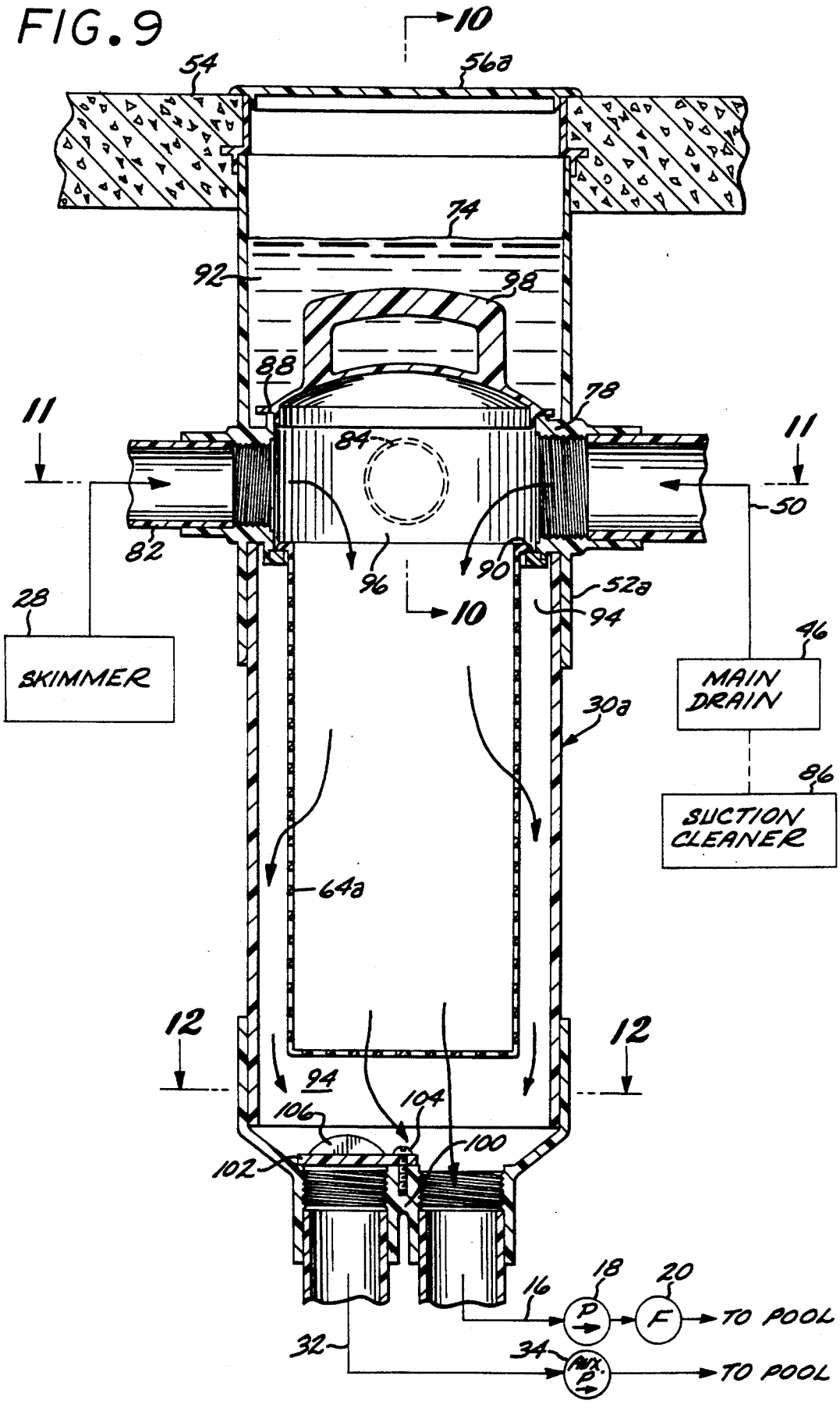
FIG. 9 is a vertical cross sectional view similar to FIG. 3, but illustrating a second form of debris collection trap.

The debris collection trap 30*a* of FIG. 9 is located at poolside recessed below the pool deck 54. This location allows it to be made relatively large for greater capacity without being obtrusive. It comprises a cylindrical, vertically elongated tank 52*a* conveniently made of several components which are suitably secured together by adhesive or the like.

The upper extremity of the tank 52*a* is mounted within an opening in the pool deck, in most cases being fitted into position when the concrete of the pool deck is poured. Its open upper end is closed by a removable cover 56*a*.

As best seen in FIG. 10, the middle portion of the tank 52*a* includes a cylindrical section 78 spaced inwardly of the adjacent wall of the tank 52*a*, but integrally connected to it for support. Such integral connection includes an annular web 80, as best seen in FIG. 11, and the internally threaded, radially inwardly extending portions of three conduit mounts. These mounts include radially outwardly extending portions adapted for adhesive or other suitable attachment, respectively, to the primary trap suction line 50, a diametrically oppositely located secondary trap suction line 82, and a balance line 84.

Typically, the line 50 is connected to the main drain 46 in order to draw in debris such as leaves from the collection inlet means 46 described in the embodiment of FIGS. 1–8. However, it could just as easily be connected to a suction cleaner, as diagrammatically indicated at 86. Such a cleaner could be of the type which is manually moved over the pool surfaces to suck in debris. The nature of the waterborne debris source does not affect the operation of the present trap 30*a*.

In similar fashion, the line 82 can be connected to a variety of sources of waterborne debris, but typically it is coupled to the usual skimmer 28 to accept debris urged into the skimmer by the action of wind and water currents.

The balance line 84, as best seen in FIG. 10, extends from the tank 52*a*, through the adjacent pool wall or side 12, and into the pool below the pool waterline 76 to establish the tank waterline 74 in the tank 52*a*.

The circular upper edge of the annular section 78 constitutes an upper seat 88. The circular lower edge of the section 78 is adhesively secured to an annular ring whose inwardly projecting ledge portion constitutes a lower seat 90.

The upper and lower seats 88 and 90 divide the tank 52*a* into an access or upper chamber 92 above the upper seat 88, a strainer or lower chamber 94 below the lower seat 90, and a manifold or intermediate chamber 96 between the seats 88 and 90.

A cylindrical, vertically elongated foraminous debris container 64*a* includes an upper circular flange which defines a central opening for receiving debris and water from the intermediate chamber 96. The container 64*a* rests upon the lower seat 90 and extends downwardly into the lower chamber 94. The container traps debris within it, while water is allowed to flow through it into the lower chamber 94.

A sealing cap 98 is provided with a circular flange adapted to seat upon the upper seat 88 to prevent the flow of water between the upper chamber 92 and the intermediate chamber 96. The cap 98 includes a handle to facilitate upward removal of the cap 98 through the opening normally closed by the cover 56*a*. When the cap 98 is removed, the container 64*a* can be reached for upward removal past the upper and lower seats 88 and 90, and out of the cover opening for emptying.

As best seen in FIG. 11, the inwardly extending portion of the conduit mount for the balance line 84 is formed to provide a balance line passage for water to flow from the balance line 84 upwardly past the tank section 78 and into the upper chamber 92.

The lower end of the tank 52*a* is closed except for a base section 100 which defines a pair of conduit mounts for connection, respectively, to the main trap discharge line 16 and the auxiliary trap discharge line 32. Flow to the line 32 can be regulated or shut off by a valve or closure 102 overlying the conduit mount for the line 32. As seen in FIGS. 9 and 12, the closure is pivotally mounted to the base section 100 by a threaded bolt 104, and it includes an integral tab 106 to facilitate turning of the closure 102 with a suitable tool to partially or fully open the line 32. This enables regulation of the amount of water drawn off by the auxiliary and main pumps 34 and 18. As will be apparent, the line 32 would be fully closed in the event that an auxiliary pump was not a part of the water recirculating system.

In operation, the development of suction by the main pump 18, and auxiliary pump 34 if one is used, draws the debris and water mixture into the intermediate chamber 96 through the primary trap suction line 50, and also through the secondary trap suction line 82, if that is used. In that regard, it will be apparent that the conduit mount for the suction line 82 could be closed off with a suitable plug or cap if suction from the skimmer 28, for example, was not desired.

The debris and water mixture then passes into the container 64*a*, which retains the debris and allows the water to flow into the lower chamber for discharge back into the pool.

Because of the presence of water in the upper chamber 92, the sealing cap 98 provides a flooded seal which prevents the entry of air into the pump suction system. No positive sealing clamps or the like are required to effectuate a satisfactory seal to prevent the loss of pump prime when the cap 98 is in seated position.

Figure 13:
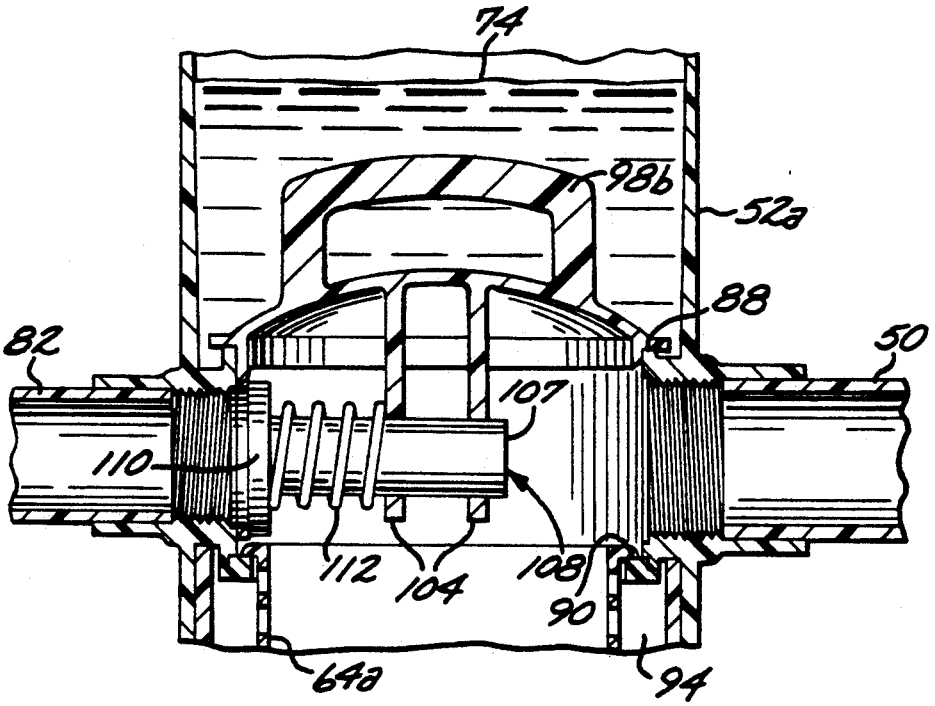
FIG. 13 is a view similar to that of FIG. 9, but illustrating a second embodiment of sealing cap.
Figure 14:
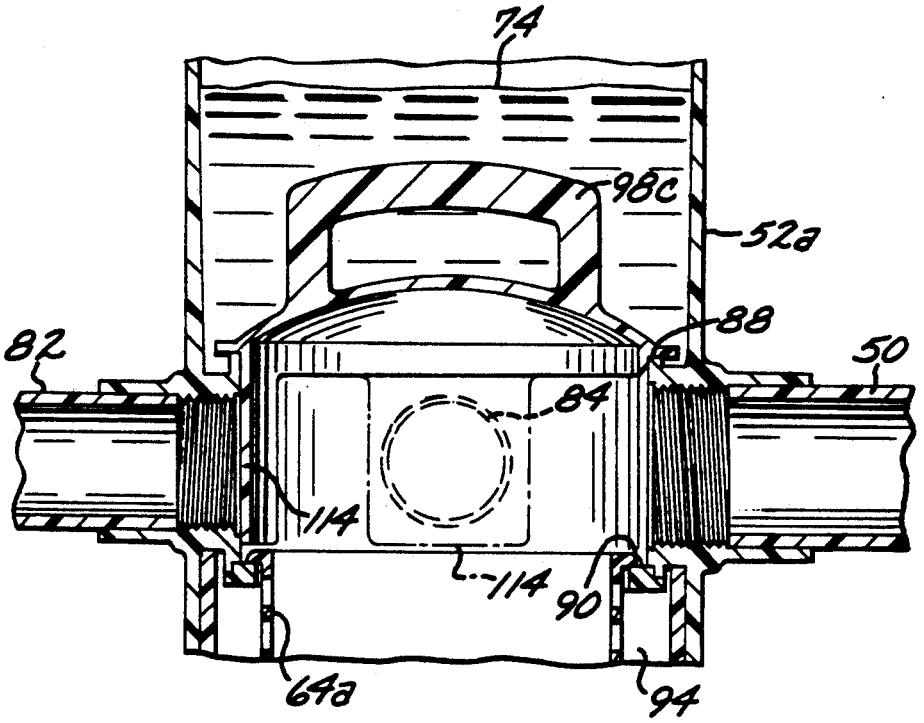
FIG. 14 is a view similar to FIG. 13, but illustrating a third embodiment of sealing cap, the phantom lines showing other rotated positions of the cap.

Different embodiments of sealing cap are illustrated in FIGS. 13 and 14. These are similar in construction to the cap 98. For convenience, identical parts are assigned the same number, similar parts are assigned the notation "b" for the embodiment of FIG. 13 and "c" for the embodiment of FIG. 14, while different parts are assigned a new number.

The cap 98*a* of FIG. 13 is operative to automatically prevent the development of an excessive vacuum in the primary suction line 50. For this purpose the cap 98*a* includes a pair of integral, downwardly extending trunnions 104 having aligned apertures which slidably receive the cylindrical shank 106 of a valve or closure 108. One end of the shank 106 includes a circular head 110 having a flat face normally seated in sealing relation against the surfaces defining the opening in the conduit mount for the line 82. The head 110 is urged into such sealing relation by a compression spring 112 fitted over the shank 106 and engaging at its opposite ends the head 110 and the adjacent one of the trunnions 104. Upon development of an excessive suction or differential pressure across the head 110, because of blockage of the line 50 by an overload of debris such as leaves, for example, the head will move inwardly against the bias of the spring 112 and open the passage to the line 82 to relieve the pressure differential.

In the embodiment of FIG. 14, the sealing cap 98c includes a depending regulating skirt or plate 114 which extends in relatively close relation to the entry passages to the suction lines 82 and 50. The plate 114 is shown in full lines in the position in which it completely blocks water flow from the line 82. On rotation of the cap 98c through 180 degrees, the plate 114 will be located in a diametrically opposite position, as indicated by the phantom lines, so that water flow from line 50 will be blocked and water flow from line 82 will be permitted. In a midway position, as also seen in phantom lines, the plate 114 will be out of alignment with the openings to both lines 82 and 50 and free flow from those lines will be permitted.

Although not shown, it will be apparent that the debris collection trap of the present invention is easily adapted to various plumbing conditions, according to the design of the pool and its water recirculating system. More particularly, any one or more of the conduit mounts for the conduits or lines 82, 50, 32 and 16 can be plugged or capped to suit the trap for use with one or two pump systems, or to suit the trap for use with various combinations of skimmer and main drain suction and discharge lines. This makes the trap extremely versatile, and universal in application without any need for major changes in the structure of the trap.

Various modifications and changes may be made with regard to the foregoing detailed description without departing from the spirit of the invention.

What is claimed is:

1. A swimming pool debris collection trap for separating debris from pool water passing through a water recirculating system, the debris collection trap comprising:

tank means located externally of the pool and including upper and lower seats dividing the tank means into an upper chamber above the upper seat, a lower chamber below the lower seat, and an intermediate chamber between the upper and lower seats for connection to a primary trap suction line for receiving pool water and debris, the tank means further including a balance passage in communication with a balance line coupled to the pool for filling the upper chamber to a level above the upper seat, the tank means further including a pair of discharge openings for discharging water from the lower chamber into a main trap discharge line and an auxiliary trap discharge line, and further including a closure operative to selectively close the discharge opening leading to the auxiliary trap discharge line;

a foraminous container seated upon the lower seat and extending into the lower chamber, the container having an opening for receiving pool water and debris from the intermediate chamber, the container being operative to trap debris in the container and allow the water to flow into the lower chamber for return to the pool through the main trap discharge line; and a sealing cap seated upon the upper seat to prevent water flow between the upper and intermediate chambers, and removable from the upper seat to enable withdrawal of the container from the tank means past the lower and upper seats.

2. A swimming pool debris collection trap for separating debris from pool water passing through a water recirculating system, the debris collection trap comprising:

tank means located externally of the pool and including upper and lower seats dividing the tank means into an upper chamber above the upper seat, a lower chamber below the lower seat, and an intermediate chamber between the upper and lower seats for connection to a primary trap suction line for receiving pool water and debris, the tank means further including a balance passage in communication with a balance line coupled to the pool for filling the upper chamber to a level above the upper seat, the tank means further including openings into the primary trap suction line and into a secondary trap suction line;

a foraminous container seated upon the lower seat and extending into the lower chamber, the container having an opening for receiving pool water and debris from the intermediate chamber, the container being operative to trap debris in the container and allow the water to flow into the lower chamber for return to the pool through the main trap discharge line; and a sealing cap seated upon the upper seat to prevent water flow between the upper and intermediate chambers, and removable from the upper seat to enable withdrawal of the container from the tank means past the lower and upper seats, the sealing cap including a closure between the openings into the primary trap suction line and into the secondary trap suction line, means for slidably supporting the closure for movement between closed and open positions blocking and opening, respectively, the opening to the secondary trap suction line, and bias means urging the closure toward its closed position in the absence of a predetermined pressure differential across the closure.

3. A swimming pool debris collection trap for separating debris from pool water passing through a water recirculating system, the debris collection trap comprising:

tank means located externally of the pool and including upper and lower seats dividing the tank means into an upper chamber above the upper seat, a lower chamber below the lower seat, and an intermediate chamber between the upper and lower seats for connection to a primary trap suction line for receiving pool water and debris, the tank means further including a balance passage in communication with a balance line coupled to the pool for filling the upper chamber to a level above the upper seat, the tank means further including openings into the primary trap suction line and into a secondary trap suction line;

a foraminous container seated upon the lower seat and extending into the lower chamber, the container having an opening for receiving pool water and debris from the intermediate chamber, the container being operative to trap debris in the container and allow the water to flow into the lower chamber for return to the pool through the main trap discharge line; and a sealing cap seated upon the upper seat to prevent water flow between the upper and intermediate chambers, and removable from the upper seat to enable withdrawal of the container from the tank means past the lower and upper seats the sealing cap being rotatable and including a skirt portion positionable on rotation of the sealing cap to selectively block one or the other of the openings into the primary trap suction line and into the secondary trap suction line, or neither of the openings, to thereby regulate water flow into the intermediate chamber.

4. In combination with a swimming pool having a side wall, a pool deck, a relatively enlarged debris catchment main drain to accept and pass leaves and larger debris, a primary trap suction lien coupled to the main drain, a skimmer, a secondary trap suction lien coupled to the skimmer and to the intermediate chamber, a main pump, a main trap discharge line coupled to the pump, and a balance line coupled to the pool below the level of the pool water-line, and a combination of fixed and rotatable jets for urging leaves and large debris into the main drain, an improved debris collection trap comprising:

tank means disposed through the pool deck and including upper and lower seats dividing the tank means into an upper chamber above the upper seat, a lower chamber below the lower seat coupled to the main trap discharge line, and an intermediate chamber between the upper and lower seats coupled to the primary trap suction line for receiving pool water and debris from the main drain, the tank means further including a balance passage coupled to the balance line for filling the upper chamber to a level above the upper seat;

a cylindrical formainous container, having a diameter less than that of the upper seat, the container being seated upon the lower seat and extending into the lower chamber, and the container having an opening for receiving pool water and debris from the intermediate chamber, the container being operative to trap debris int he container and allow pool water to flow into the lower chamber for return to the pool through the main trap discharge line; and a sealing cap seated upon the upper seat to prevent water flow between the upper and intermediate chambers, and removable from the upper seat to enable withdrawal of the container from the trap means past the lower and upper seats.

5. A combination according to claim 4 and including pressure relief means located in the intermediate chamber, normally preventing debris and water flow from the secondary trap suction line, and operative to enable such flow upon development of a predetermined suction level in the primary trap suction line.

6. A combination according to claim 5 wherein the pressure relief means are carried by the sealing cap.

7. A combination according to claim 4 and including flow regulating means located in the intermediate chamber and operative to selectively block or enable water flow from the primary and secondary trap suction lines, respectively.

8. A combination according to claim 7 wherein the flow regulating means are carried by the sealing cap.

9. In combination with a swimming pool filled with water and having a balance line characterized by a submerged portion in communication with the water below the pool water surface; and a water circulating system having a suction line for drawing water and debris from the pool; an improved swimming pool debris collection trap comprising:

tank means including an upper access chamber, a strainer chamber, a manifold chamber located between the access and strainer chambers, the manifold chamber being coupled to the suction line for receiving water and debris from the suction line, the access chamber being coupled to the balance line for filling the access chamber with water to a level approximating the level of the pool water surface whereby air cannot enter the manifold chamber from the access chamber;

a foraminous strainer located between the manifold and strainer chambers and extending into the strainer chamber, the strainer having an opening for receiving water and debris from the manifold chamber, the strainer being operative to trap debris from the manifold chamber and allow water to flow from the strainer into the strainer chamber for return to the pool; and a cap located between the access chamber and the manifold chamber to substantially prevent water flow from the access chamber to the manifold chamber, the cap being removable to allow access to the strainer for withdrawal of the strainer from the tank means for emptying debris, the portion of the tank means which defines the access chamber closing off the access chamber from lateral flow into the access chamber of leaves and other debris borne upon the pool water surface.

10. In combination with a swimming pool having a side wall, a pool deck, a relatively enlarged debris catchment main drain to accept and pass water and debris as large as leaves, a primary trap suction lie coupled to the main drain, a main pump, a main trap discharge line coupled to the pump, and a balance line coupled to the pool through the side wall at a point below the pool water surface, and a combination of fixed and rotatable jets for urging leaves and debris into the main drain, an improved debris collection trap comprising:

tank means disposed through the pool deck and including upper and lower seats dividing the tank means into an upper chamber located above the upper seat, a lower chamber located below the lower seat and coupled to the main trap discharge line, and an intermediate chamber located between the upper and lower seats and coupled to the primary trap suction line for receiving water and debris from the main drain, the tank means further including a balance passage coupled to the balance line for filling the upper chamber to a level above the upper seat approximately the level of the pool water surface whereby air cannot enter the intermediate chamber from the upper chamber;

a cylindrical foraminous container having a diameter less than that of the upper seat, the container being seated upon the lower seat and extending into the lower chamber, the container further having an opening for receiving water and debris from the intermediate chamber, and the container being operative to trap debris in the container and allow water to flow into the lower chamber for return to the pool through the main trap discharge line; and a cap seated upon the upper seat to substantially prevent water flow between the upper and intermediate chambers, and removable from the upper seat to enable withdrawal of the container from the trap means past the lower and upper seats, the portion of the tank means defining the upper chamber closing off the upper chamber from any lateral flow into the upper chamber of debris borne upon the pool water surface.

11. A swimming pool debris collection trap for separating debris from the water in a swimming pool having a balance line in communication with the water below the pool water surface, and further having a water circulating system having a suction lien for drawing water and debris from the pool, the swimming pool debris collection trap comprising:

tank means for location adjacent the pool in isolation from the pool water surface, and including an upper access chamber, a strainer chamber, a manifold chamber located between the access and strainer chambers, the manifold chamber being adapted for coupling to the suction lien for receiving water and debris from the suction line, the access chamber being adapted for coupling to the balance line for filling the access chamber with water to a level approximating the level of the pool water surface whereby air cannot enter the manifold chamber from the access chamber;

a foraminous strainer located between the manifold and strainer chambers and extending into the strainer chamber, the strainer having an opening for receiving water and debris from the manifold chamber, the strainer being operative to trap debris from the manifold chamber and allow water to flow from the strainer into the strainer chamber for return to the pool; and a cap located between the access chamber and the manifold chamber to substantially prevent water flow from the access chamber to the manifold chamber, the cap being removable to allow access to the strainer for withdrawal of the strainer from the tank means for emptying debris, the portion of the tank means which defines the access chamber closing off the access chamber from the free surface of the pool water to prevent lateral flow into the access chamber of leaves and other debris borne upon the pool water surface.

* * * * *